United States Patent [19]

Rigazio et al.

[11] 4,388,002

[45] Jun. 14, 1983

[54] CONNECTOR FOR ARRANGEMENT FOR A-C. CLOCK MECHANISM

[75] Inventors: Anthony W. Rigazio, Oglesby; Donald E. Mathieson, Peru, both of Ill.; Paul E. Hawkinson, Louisville, Miss.

[73] Assignee: Spartus Corporation, Skokie, Ill.

[21] Appl. No.: 212,356

[22] Filed: Dec. 3, 1980

[51] Int. Cl.[3] ..... G04C 10/00

[52] U.S. Cl. ..... 368/88

[58] Field of Search ..... 368/160, 88; 339/147 P, 339/186 R, 186 N; 200/38 DA

[56] References Cited

U.S. PATENT DOCUMENTS

| | | | |
|---|---|---|---|
| 3,025,490 | 3/1962 | Hicks | 339/147 P |
| 3,145,675 | 8/1964 | Momberg et al. | 339/147 P |
| 3,581,029 | 9/1968 | Noiles | 200/38 DA |
| 3,925,629 | 12/1975 | Albinger | 200/38 DA |
| 3,988,639 | 10/1976 | Preiser et al. | 339/147 P |
| 4,316,277 | 2/1982 | Endo | 368/88 |

*Primary Examiner*—J. V. Truhe
*Assistant Examiner*—Forester W. Isen
*Attorney, Agent, or Firm*—Leydig, Voit, Osann, Mayer & Holt, Ltd.

[57] ABSTRACT

A connector arrangement for an a-c. clock mechanism which includes a drive coil and drive train mounted in a housing formed of a plastic base plate and plastic cover member of shallow cup shape. The drive coil has a core and bobbin, the bobbin being secured by embossments in the housing so that the rear end thereof is spaced from the adjacent side wall to form a wide access space. A pair of vertically spaced axially extending prongs mounted on the edge of the bobbin and electrically connected to the drive coil project into the access space. An access opening in the adjacent side wall of the housing alined with the prongs on the bobbin provides entry into the access space. The access opening is of arbitrary cross sectional shape and small enough to preclude entry of a connector of conventional design. For supplying current to the drive coil the a-c. line cord has a connector with a tip portion cross sectionally fitted for snug reception in the access opening as well as a handle portion alined therewith. The tip portion of the connector has female electrical connections for engaging the prongs while the handle portion of the connector, which extends outside of the housing, includes a voltage dropping resistor, the heat of which is dissipated to the ambient atmosphere.

2 Claims, 6 Drawing Figures

CONNECTOR FOR ARRANGEMENT FOR A-C. CLOCK MECHANISM

The manufacture of a-c. clock mechanisms is highly competitive so that most clocks now consist of a plastic movement in a plastic case. Special lower power motors have been developed operating on low voltage a-c. to provide commonality of construction between a motor intended for use with a line cord and a motor intended for driving with alternating voltage obtained from "quartz" circuitry powered by a flashlight cell. Because of the low voltage it has been necessary to interpose an impedance in the line core usually in the form of a resistor. Many efforts to shave a penny or two in a clock mechanism of this kind have been self-defeating, resulting in degradation of quality, manufacturing complications, and reduced safety for the user and the device itself.

It is an object of the present invention to provide an a-c. clock, and particularly connector arrangement therefor, which is highly economical to construct and assemble, which is extremely simple consisting of a minimum number of parts and a minimum of soldered connections, and which is safe and reliable insuring that the prescribed resistor will be in the circuit to reduce the voltage to an operating level from the high voltage of the line whenever the clock is energized.

It is another object of the invention to provide a connector arrangement for an electric clock which permits the unit to be progressively assembled in a production line free of the impediment of a dangling line cord. This not only avoids a common nuisance but makes the units more susceptible to fully automated assembly techniques. In this connection it is an object to provide an electric clock mechanism which is freely pluggable into a test fixture at the end of the line for testing at rated voltage, the final step prior to use or shipment being the plugging in of a line cord connector containing a dropping resistor.

It is a further object to provide a synchronous electric clock having a housing containing a pair of prongs reachable only through a narrow access opening and engageable by a connector having a narrow tip portion cross sectionally fitted for snug reception in the access opening and an integral handle portion for plugging and unplugging, the handle portion extending outside of the clock housing and containing a dropping resistor so that the heat of the resistor is dissipated to the ambient atmosphere.

It is a more specific object to provide an a-c. clock mounted in a housing and having a connector which projects through the wall of the housing through an access opening providing a special keyed connection between the opening and the connector precluding entry of a connector of nonauthorized type.

It is still another object of the invention to provide, in an a-c. clock, a drive coil having a pair of prongs totally contained within the housing of the device and which are engageable via plugged-in connector, with the prongs being directly connected to the bobbin of the drive coil and with the bobbin being positively located by cooperating embossments so that the drive coil cannot be dislodged from its position by rough or careless plugging in of the connector.

Other objects and advantages of the invention will become apparent upon reading the attached detailed description and upon reference to the drawings in which.

Figure 1:
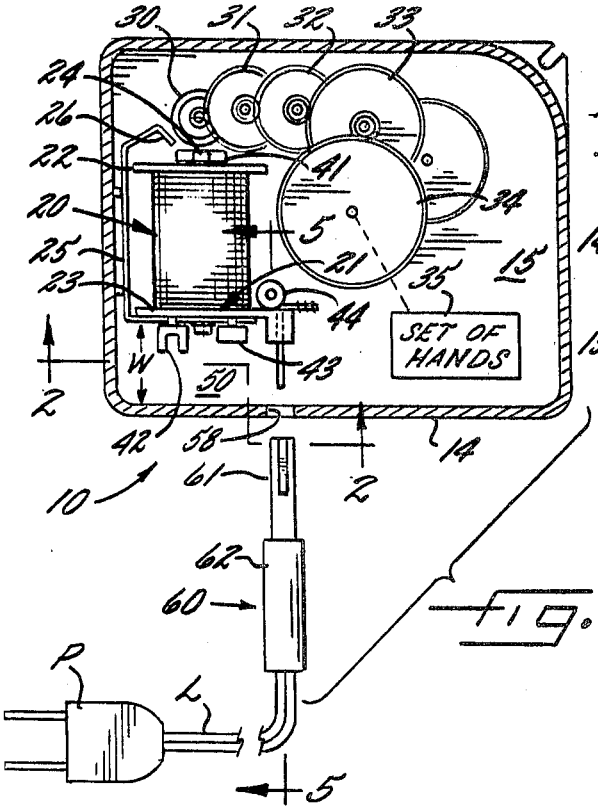
FIG. 1 is a plan view of the clock mechanism and its associated connector comprising the present invention, with the top portion of the cover member removed and as viewed along line 1—1 in FIG. 2.

While the invention has been described in connection with a preferred embodiment, it will be understood that we do not intend to limit the invention to the embodiment shown, but intend, on the contrary, to cover the various alternative and equivalent constructions included within the spirit and scope of the appended claims.

Turning to the drawings there is shown an a-c. clock mechanism mounted in a housing 10, the housing being formed of a plastic base plate 11 and a plastic cover member 12. The plastic members have a mated joint 13 and the members together define a wall 14 which encircles an enclosed space 15. A synchronous a-c. motor is used including a drive coil 20 wound upon a bobbin 21 having a front end 22 and a rear end 23 and through which extends a core 24. Coupled to the rear end of the core is a pole piece 25 which extends along the side of the bobbin terminating in a pole 26 which is angularly offset with respect to the presented tip of the core 24 so that when the coil is excited with a-c. there is a "rotating" component of flux. Such rotating component acts upon a permanently magnetized rotary armature 30 which is coupled through a series of gears 31–34 to a set of hands which have not been shown but which have been diagrammatically indicated at 35.

Figure 4:
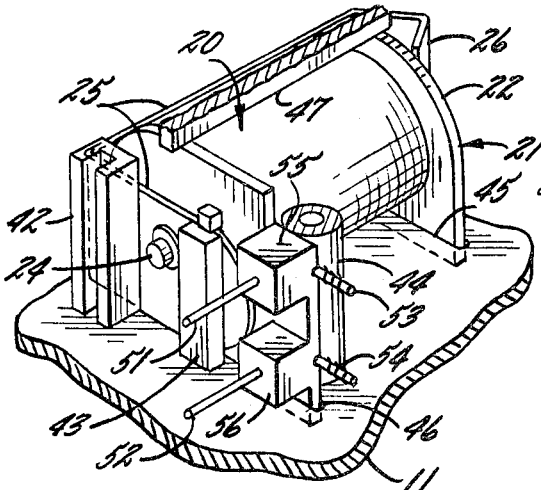
FIG. 4 is a fragmentary perspective view of the bobbin assembly.

In carrying out the present invention embossments are provided at least on the base plate 11 for securing the bobbin 21 in a position in which the rear end 23 of the bobbin is spaced from the adjacent side wall 14 and parallel thereto to form a wide access space. The embossments which support the bobbin are in the form of a first pedestal 41 at the front end of the bobbin which is notched out to cradle the core 24, a pair of pedestals 42, 43 at the rear end of the bobbin and a fourth pedestal 44 which performs a back-up function to be described. In addition, the lower edges of the front and back portions of the bobbin are preferably recessed into grooves 45, 46, respectively, which are integrally molded in the base plate. To keep the bobbin assembly seated in the grooves 45, 46 an embossment is provided on the outside of the cover member 12 extending axially of the drive coil and pressing downwardly upon the front and rear ends 22, 23 of the bobbin, such embossment being indicated at 47 in FIGS. 2 and 4. Positioning the bobbin by the embossments in the manner described defines a wide access space 50 (FIG. 1) having a width dimension w at the rear end of the bobbin.

In accordance with the invention a pair of laterally spaced axially extending prongs are mounted on the edge of the bobbin to project into the access space 50. These prongs, indicated at 51, 52 are of "L" configuration providing outwardly projecting terminals 53, 54 to which the ends of the coil are connected, preferably by soldering. The prongs are mounted in respective insulative pedestals 55, 56 which are integrally molded with the rear end 23 of the bobbin.

Further in accordance with the invention an access opening is provided in the adjacent side wall 14 of the housing alined with the prongs on the bobbin, such access opening, indicated at 58 is of such arbitrary cross sectional shape and of such small size as to preclude entry of a connector of conventional design, that is to say, an "unauthorized" connector.

Figure 5:
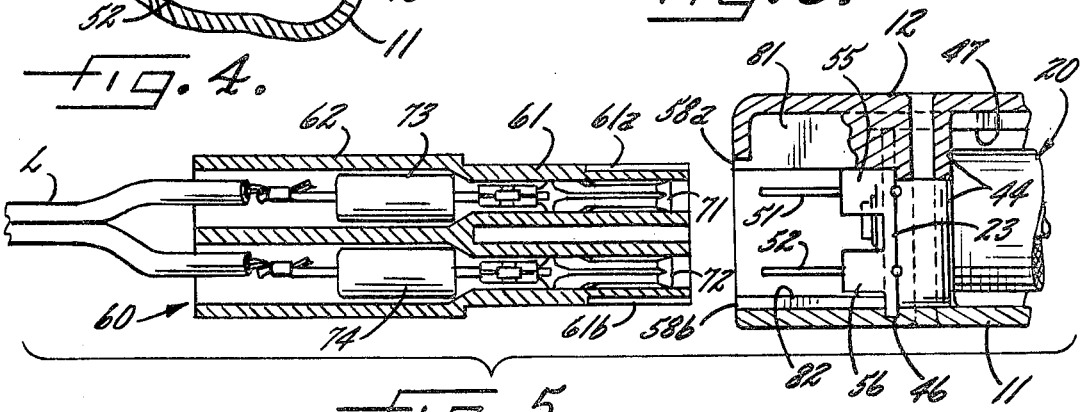
FIG. 5 is a fragmentary vertical section taken through the connector looking along line 5—5 in FIG. 1.

Instead, in accordance with the invention, a special connector 60 is provided fed through a line cord L from a wall plug P, the connector having a tip portion 61 which is cross sectionally fitted for snug reception in the access opening 58 and a handle portion 62, the two portions being preferably of plastic and molded integrally with one another. For providing arbitrary keyed engagement between the tip portion of the connector and the access opening 58, the opening 58 is provided with inwardly extending key projections **58*a*, 58*b* (see FIG. 2) which are respectively received and accommodated in grooves 61*a*, 61*b* (see also FIG. 5) in the connector tip. Female electrical connections 71, 72 are recessed in the tip to register, and make contact, with the prongs 51, 52, respectively. The female connections 71, 72 are respectively connected to resistors 73, 74 in the handle 62 of the connector, the resistors, as shown, being connected in series with the conductors of the line cord L. The length of the tip portion 61** of the connector is greater than the width w of the access space so that the handle portion of the connector remains outside of the housing when the connector is plugged into the access opening for dissipation of the heat of the resistors to the ambient atmosphere. Since more than eighty-five percent of the heat of the system is dissipated in the resistors, this insures that the amount of heat liberated in the enclosure is at such a low level as to be negligible.

Figure 2:
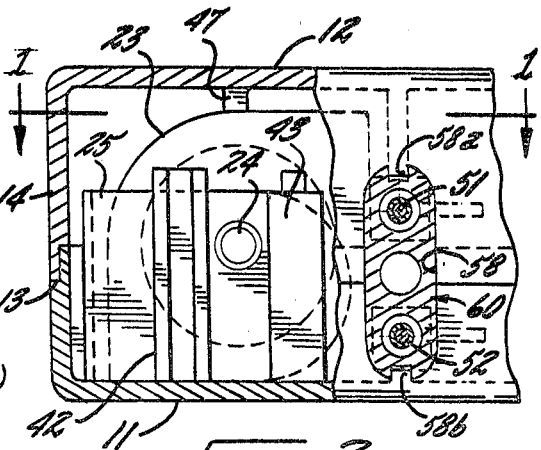
FIG. 2 is a fragmentary elevational view taken along section line 2—2 in FIG. 1.
Figure 3:
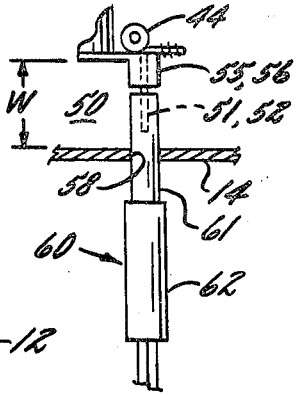
FIG. 3 is a fragmentary plan view showing the connector in its plugged in condition.
Figure 6:
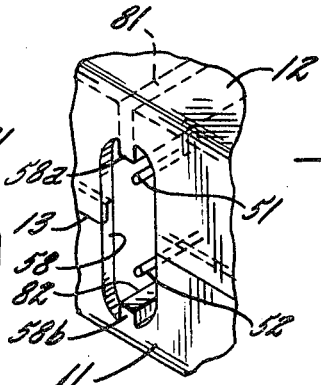
FIG. 6 is a fragmentary perspective showing the access opening and guiding fins.

In accordance with one of the aspects of the invention fins are internally molded on the base plate and cover member extending from the access opening in the direction of, and parallel to, the prongs, with the edges of the fins being received in the longitudinal grooves **61*a*, 61*b* (FIG. 5) formed in the connector. In short, fins are provided forming a rearward extension of the key elements 58*a*, 58*b* (FIG. 2). The fins which are integrally formed in the cover member and base plate are indicated respectively at 81, 82, being shown in side elevation in FIG. 5 and in perspective in FIG. 6. The fins insure that once the tip 61 of the connector has been entered into the opening 58** the connector is guided surely and positively into mated engagement with the prongs, notwithstanding the fact that the prongs are deeply recessed within the access space.

It is, finally, one of the features of the construction that a pillar, indicated at 44 (FIGS. 1, 2 and 4), is formed on the base plate 11 in back-up engagement with the prongs 51, 52 to block movement of the prongs, and the bobbin in which they are mounted, in the event that excess force is applied to the connector. The pillar 44 is preferably integrally molded with the base plate, of strong construction, and substantially alined with the prongs at the bend of the "L". Thus in the event that the connector 60 is plugged in roughly or carelessly so that excess reaction force is developed in the prongs, such reaction force is transmitted directly to the pillar 44 and does not have to be absorbed by the bobbin mounting. Thus there is no possibility that plugging in of the connector will disrupt the accurately established spacing between the pole pieces and the armature. The pillar 44 also protects the bobbin in the event that any attempt is made to force the connector into the housing beyond its normal contact making position, although, as an additional safeguard against over-insertion, the grooves **61*a*, 61*b*** in the connector are preferably foreshortened.

It will be apparent that the construction described above amply fulfulls the objects of the invention. The construction is highly economical and, since the parts are simply dropped into place, it is ideally suited to automated assembly in a production line. During assembly the unit is free of the nuisance of a dangling line cord, permitting the plugging in of the unit itslef for test purposes.

Since the prongs which make electrical connection to the drive coil are deeply recessed in the housing and accessible only to a specialized connector construction containing a dropping resistor, there is no risk that the motor may be inadvertently operated at line voltage, which would have destructive effect.

The clock mechanism may be operated in confined quarters with assurance that there will be no build-up of heat within the housing.

While the plug in connector directly engages prongs on the bobbin there is no risk that plugging in the connector roughly or with excessive force will dislodge the bobbin with respect to the armature to which it must precisely relate.

While it is the purpose of the present invention to energize a synchronous motor from a regular a-c. supply line, the described construction except for the connector 60 is intended equally for driving by "quartz" circuitry which may be mounted on a miniaturized circuit board readily accommodated adjacent the wall 14 of the housing. Thus the connector 60 may be locked upon as a means for "converting" from "quartz" to "line" energization.

What is claimed is:

1. In a synchronous a-c. clock the combination comprising a housing, the housing being formed of a plastic base plate and plastic cover member of shallow cup shaped mated together about the periphery to form an enclosed space having side walls, a drive coil having a core and bobbin mounted in the enclosed space, a drive train mounted in the enclosed space, a permanently magnetic rotary armature cooperating with the core at the front end of the bobbin for driving the drive train, embossments at least on the base plate for securing the bobbin in a position in which the rear end of the bobbin is spaced from the adjacent side wall and parallel thereto to form a wide access space, a pair of spaced axially extending prongs mounted on the edge of the bobbin and projecting into the access space, the ends of the drive coil being connected to the respective prongs, means defining an access opening in the adjacent side wall of the housing alined with the prongs on the bobbin for providing communication with the access space, the access opening being of arbitrary cross sectional shape and of such small size as to preclude entry of an a-c. connector of conventional design, a line cord having a connector, the connector having a tip portion cross sectionally fitted for snug reception in the access opening and having a a handle portion, female electrical connections in the tip portion for engaging the prongs of resistor means in the handle portion in series with the line cord, the length of the tip portion being greater than the width of the access space so that the handle portion of the connector remains outside of the housing when the connector is plugged into the access opening for dissipation of the heat of the resistor means to the ambient atmosphere.

2. The combination as claimed in claim 1 in which fins are internally molded in the base plate and cover member extending from the access opening in the direction of, and parallel to, the prongs, the tip portion of the connector having longitudinal grooves formed along opposite edges for mating with the fins so that the tip portion of the connector upon insertion into the access opening is positively guided over the width of the access space for making of electrical connection with the prongs, and a pillar on the base plate in back-up engagement with the prongs to block movement thereof in response to insertion force applied to the connector.

* * * * *

UNITED STATES PATENT AND TRADEMARK OFFICE

CERTIFICATE OF CORRECTION

PATENT NO. : 4,388,002

DATED : June 14, 1983

INVENTOR(S) : Anthony W. Rigazio et al.

It is certified that error appears in the above-identified patent and that said Letters Patent are hereby corrected as shown below:

Column 2, lines 57 and 58, delete "outside" and insert -- inside --;

Column 4, line 15, delete "itslef" and insert -- itself --.

Signed and Sealed this

*Twentieth* Day of *September 1983*

[SEAL]

*Attest:*

GERALD J. MOSSINGHOFF

*Attesting Officer*

*Commissioner of Patents and Trademarks*